United States Patent [19]

Koch

[11] Patent Number: 4,621,611

[45] Date of Patent: Nov. 11, 1986

[54] GRATE ROD

[76] Inventor: Theodor Koch, Butzenstrasse 20, 8304 Wallisellen, Switzerland

[21] Appl. No.: 705,436

[22] PCT Filed: May 18, 1984

[86] PCT No.: PCT/CH84/00080

§ 371 Date: Jan. 22, 1985

§ 102(e) Date: Jan. 22, 1985

[87] PCT Pub. No.: WO84/04799

PCT Pub. Date: Dec. 6, 1984

[30] Foreign Application Priority Data

May 20, 1983 [CH] Switzerland ..... 2767/83

[51] Int. Cl.[4] ..... F23H 7/08

[52] U.S. Cl. ..... 126/174; 126/180; 110/281

[58] Field of Search ..... 126/152 R, 176 R, 174, 126/180, 175, 155, 167, 168; 110/268, 278, 280–284, 273; 198/771, 773

[56] References Cited

U.S. PATENT DOCUMENTS

| | | | |
|---|---|---|---|
| 1,099,682 | 6/1914 | Wright | 110/280 |
| 1,820,932 | 9/1931 | Blewett | 110/281 |
| 3,126,846 | 3/1964 | Wagner | 110/281 |

FOREIGN PATENT DOCUMENTS

| | | | |
|---|---|---|---|
| 1134329 | 8/1962 | Fed. Rep. of Germany | 110/281 |
| 2519738 | 7/1983 | France | 110/281 |
| 178038 | 4/1922 | United Kingdom | 126/180 |

*Primary Examiner*—James C. Yeung

*Attorney, Agent, or Firm*—Antonelli, Terry & Wands

[57] ABSTRACT

To prolong the life of grate rods which have holders at one end for the rod holding elements of a grate, and have at the other end a support part for preferably inclined support on another rod, it is proposed that both a holder in the form of a recess and a support part be provided at each end of the rod. In this way, when the end of the rod used as the support part wears out, the rod can be turned so that its holder rests on this worn end.

6 Claims, 2 Drawing Figures

GRATE ROD

The present invention relates to a grate rod with a holder at one of its ends for rod holding elements of the grate, as well as a supporting part at its other end for preferably inclined support on one end of another rod.

The aim underlying the present invention essentially resides in providing a grate rod holder and support of the aforementioned type which ensures a long service life.

More particularly, in accordance with the present invention, both ends of the grate bar are provided with a holder means and a support part.

Advantageously, in accordance with further features of the present invention, the holders are formed by recesses or indentations running at least nearly perpendicular to the longitudinal axis of the rod.

In accordance with still further features of the present invention, the support parts are formed by elements projecting in a plane running longitudinally of the rod.

Figure 1:
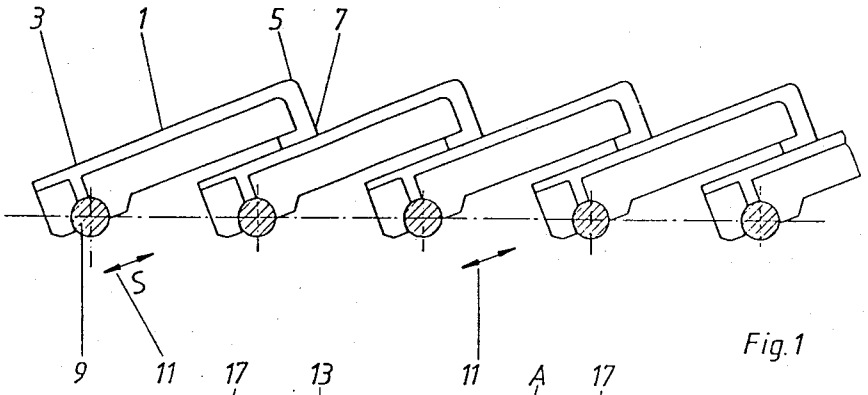
FIG. 1 is a schematic view of a conventional grate rod holder and support.

As shown schematically in FIG. 1, grate rods 1 are known which have a holder in the form of a recess at one end 3 and have a projecting support part 7 at the other end 5. Such grate rods 1 are supported by their holders at end 3 on grate rods 9, so that they rest tilted against one another, while the supporting part 7 of one rod rests on the end of the previous rod 1 with holder 3. In view of their use, such grate rods are subjected to extreme thermal stress, whereby this is especially true of the exposed supporting parts 7, while the other end 3 of rod 1 is covered by the previous grate bar. For this reason, such rods 1 must be replaced often because the opposed supporting parts 7 has worn away, but it is additionally subjected to stress by stoking, which usually occurs as a result of relative longitudinal displacement of every other grate rod relative to the others, as indicated by S in FIG. 1.

Figure 2:
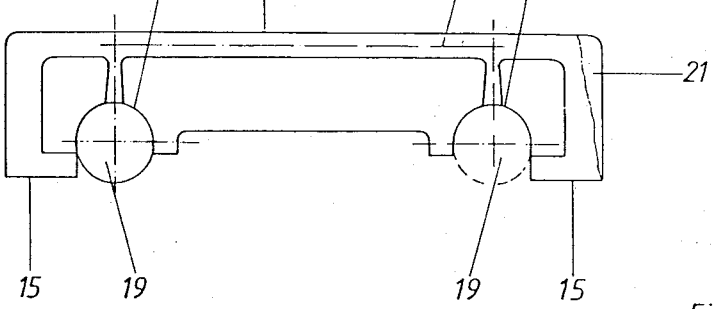
FIG. 2 is a side elevational view of a grate rod holder and support constructed in accordance with the present invention.

As shown in FIG. 2, in accordance with the present invention, A rod 13 has support parts 15 at each end, with the support parts 15 being formed by bending the ends of the rod 13 ina rod cross-sectional plane including the longitudinal axis A of the rod. A holder indentation or recess 17 is provided on the inside of bent support parts 15, with the indentation 17, as shown at the left of FIG. 2, holding rod 13 on a grate bar 19. As a result of the symmetric arrangement of rod 13, with respect to holding recesses or indentations 17 and the support parts 15, the rod 13, in the event of wear of one support part 15, as shown schematically at 21, can simply be turned and placed on the corresponding second indentation recesses 17 on bar 19. As can be seen, the wear 21 of the rod end resting on support part 15 has no deleterious effect whatever on the use of the same part of the bar, with its recess indentation 17 for mounting on rod 19. Rod 13 is preferably made in one piece without welding.

I claim:

1. A grate bar for use in a furnace grate wherein a plurality of grate bars are arranged at one of their end portions in rows on a respective grate rod and wherein said rows of bars overlap each other so that said one of their end portions are protected from furnace wear by the other of said end portions of said bars of a next row, said rows being linearely movable forth and back on and relative to each other propelled by respective rods, said grate bar comprising at each end portion a link means for one of said rods and a rest surface to rest on a bar of a subsequent row, said link means and rest surfaces of said bar enabling first using one of said end portions to rest on said rod while the other of said end portions is to rest on another bar, and after wear of said other end portion, to use each other end portion to rest on said rod and said first end portion to rest on said another bar.

2. A grate bar according to claim 1, wherein the overlapped grate bars are inclined.

3. A grate bar according to claim 1, wherein the link means are located eccentrically with regard to a midpoint between the end portions of each grate bar.

4. A grate arrangement comprising at least two grate bars and at least one grate rod, said grate bars being provided at each of their ends with means for holding them on a grate rod and being provided at each of their ends with support means for providing inclined support of one bar on an adjacent bar, at least one of said bars being held at one end thereof on said grate rod and being supported at the other end thereof on an adjacent grate bar.

5. A grate arrangement according to claim 4, wherein said holding means is formed by recesses running perpendicular to a longitudinal axis of said grate bars.

6. A grate arrangement according to claim 4, wherein said support means are formed by projections extending in a plane running in a longitudinal direction of said grate bars.

* * * * *